US007065928B1

(12) United States Patent
Lane et al.

(10) Patent No.: US 7,065,928 B1
(45) Date of Patent: Jun. 27, 2006

(54) ROOF CURB ASSEMBLY

(75) Inventors: James W. Lane, New Albany, IN (US); Joel W. Strieter, Louisville, KY (US); Paul J. Hoback, Simpsonville, KY (US); R. Scott Hoskins, LaGrange, KY (US)

(73) Assignee: KCC International Inc., Louisville, KY (US)

( * ) Notice: Subject to any disclaimer, the term of this patent is extended or adjusted under 35 U.S.C. 154(b) by 354 days.

(21) Appl. No.: 10/681,882

(22) Filed: Oct. 9, 2003

(51) Int. Cl.
*E04B 7/18* (2006.01)

(52) U.S. Cl. ..... 52/200; 52/60

(58) Field of Classification Search ..... 52/200, 52/19; 403/189, 315, 318, 375; 16/66, 271; 312/111, 257.1, 263; 40/780, 782, 783
See application file for complete search history.

(56) References Cited

U.S. PATENT DOCUMENTS

| | | | | | |
|---|---|---|---|---|---|
| 764,487 | A | | 7/1904 | Morrison | |
| 1,867,107 | A | | 7/1932 | Schmidt, Jr. | |
| 2,423,955 | A | | 7/1947 | Widener | |
| 3,113,358 | A | * | 12/1963 | Zell et al. | 312/263 |
| 3,490,797 | A | | 1/1970 | Platte | |
| 3,511,004 | A | | 5/1970 | Snellings | |
| 3,545,712 | A | * | 12/1970 | Ellis | 248/222.11 |
| 3,802,131 | A | | 4/1974 | Resech | |
| 3,926,529 | A | | 12/1975 | Brooks | |
| 4,053,245 | A | | 10/1977 | Wright | |
| 4,335,973 | A | | 6/1982 | Beck et al. | |
| 4,835,935 | A | | 6/1989 | Murphy | |
| 4,941,300 | A | | 7/1990 | Lyons, Jr. | |
| 5,016,406 | A | * | 5/1991 | Calam et al. | 52/58 |
| 5,148,647 | A | | 9/1992 | Rutledge | |
| 5,188,333 | A | * | 2/1993 | Schumacher et al. | 248/676 |
| 5,255,887 | A | | 10/1993 | Schumacher et al. | |
| 5,465,533 | A | * | 11/1995 | Rummo et al. | 52/60 |
| 6,041,557 | A | | 3/2000 | Brown et al. | |
| 6,152,552 | A | * | 11/2000 | Snoke et al. | 312/257.1 |

* cited by examiner

*Primary Examiner*—Naoko Slack
*Assistant Examiner*—Jessica Laux
(74) *Attorney, Agent, or Firm*—Camoriano and Associate; Theresa Fritz Camoriano

(57) ABSTRACT

A roof curb is made of a plurality of panels that assemble together with positive engagement without requiring the use of connectors or tools. The panels preferably are formed from flat sheets that are stamped. In a preferred embodiment, the connections include a bent end on one member, which forms a tab, and a strap on another member, which receives the tab.

11 Claims, 6 Drawing Sheets

ROOF CURB ASSEMBLY

BACKGROUND

The present invention relates to roof curb assemblies, which are used to mount air conditioners or other utilities on rooftops. There are many different types of construction for these assemblies, from a welded assembly that is fabricated entirely on the ground and then is lifted onto the rooftop using a crane or other heavy equipment, to assemblies with special fasteners that can be assembled in place on the rooftop.

SUMMARY

The present invention provides an assembly that is made in pieces that can readily be assembled without the use of tools or fasteners. This makes assembly much simpler than in prior art designs.

DESCRIPTION OF THE PREFERRED EMBODIMENT

Figure 1:
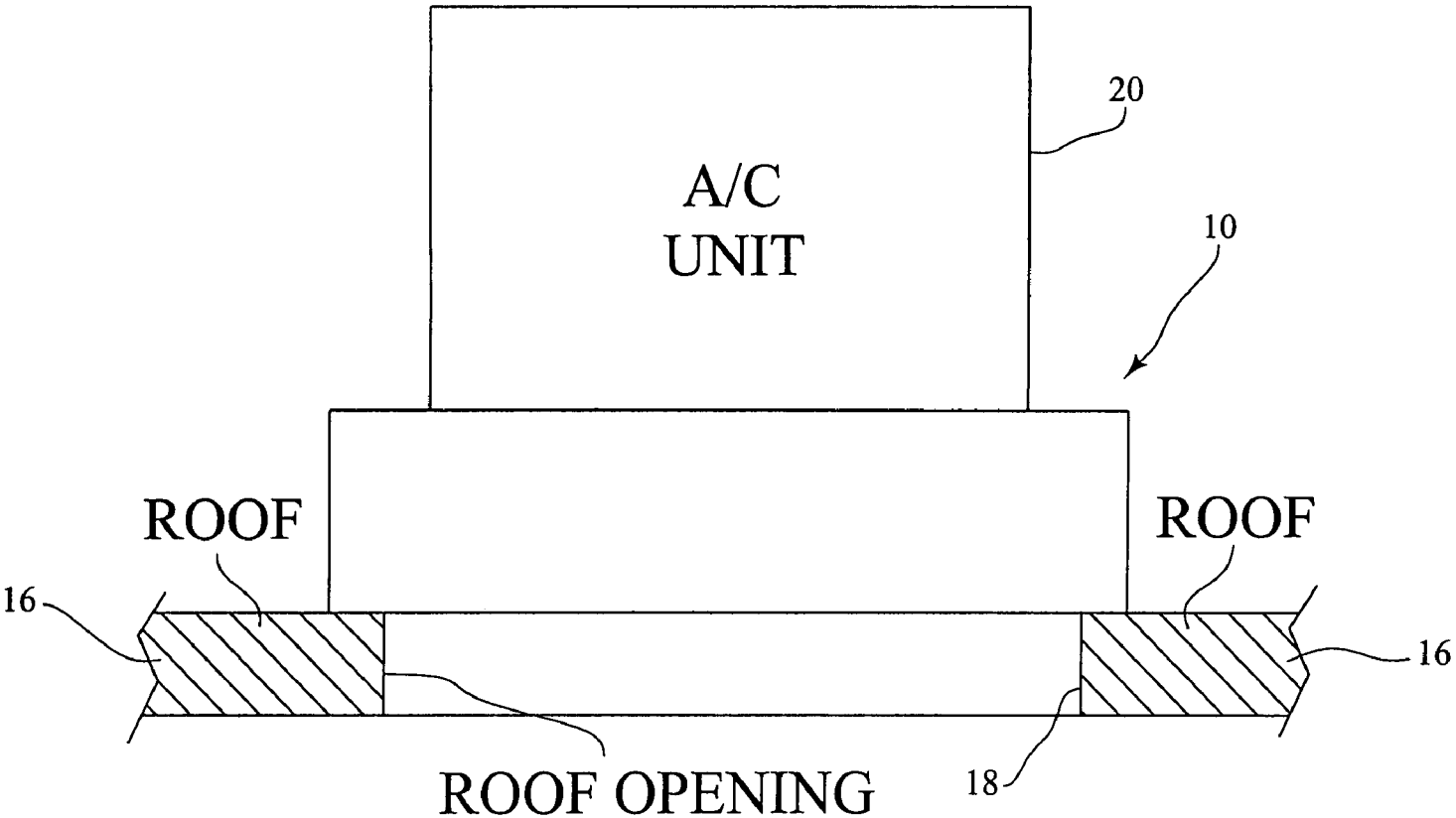
FIG. 1 is a schematic showing a curb assembly of the present invention mounted on a roof opening.
Figure 2:
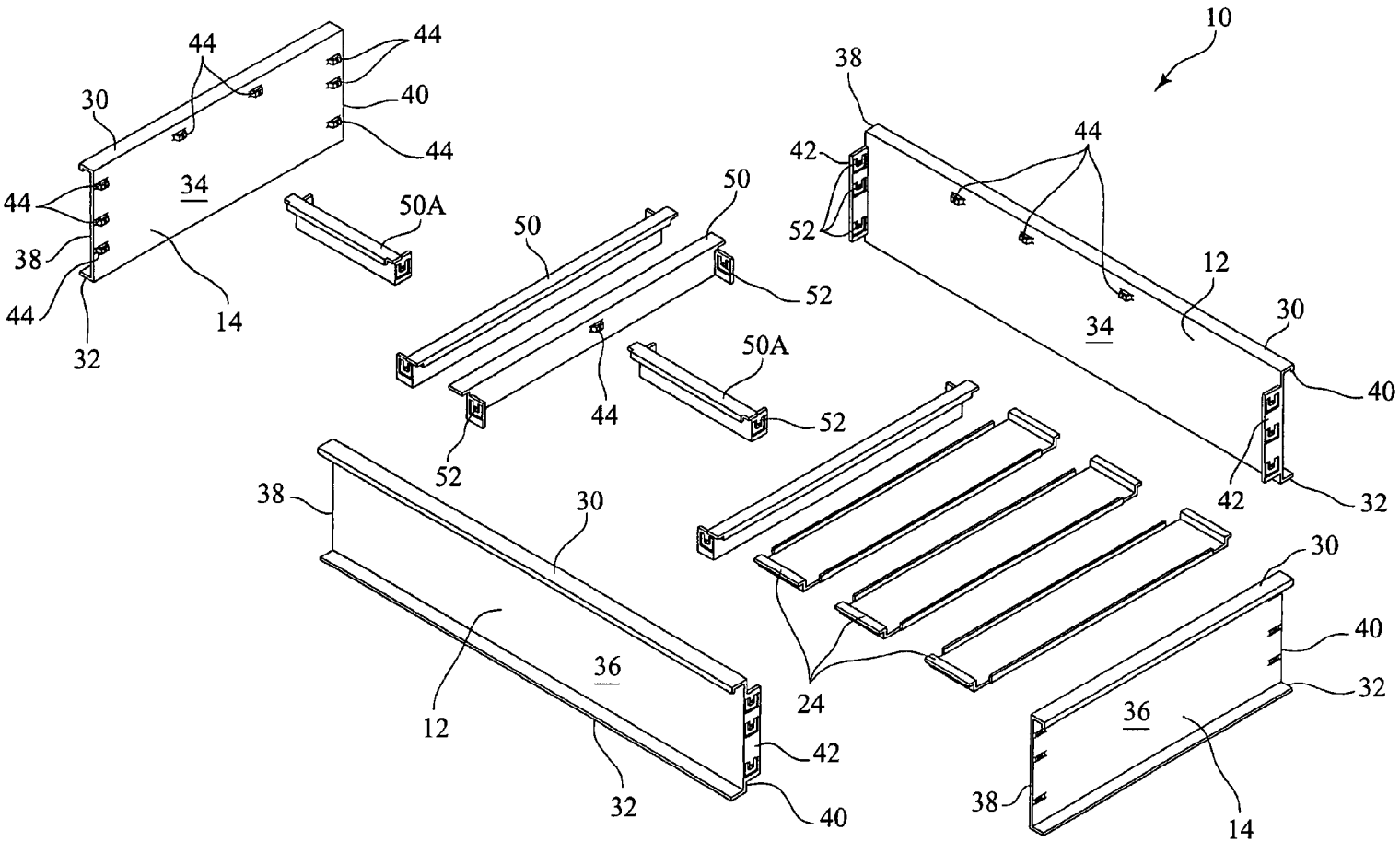
FIG. 2 is an exploded perspective view of a curb assembly made in accordance with the present invention.
Figure 4:
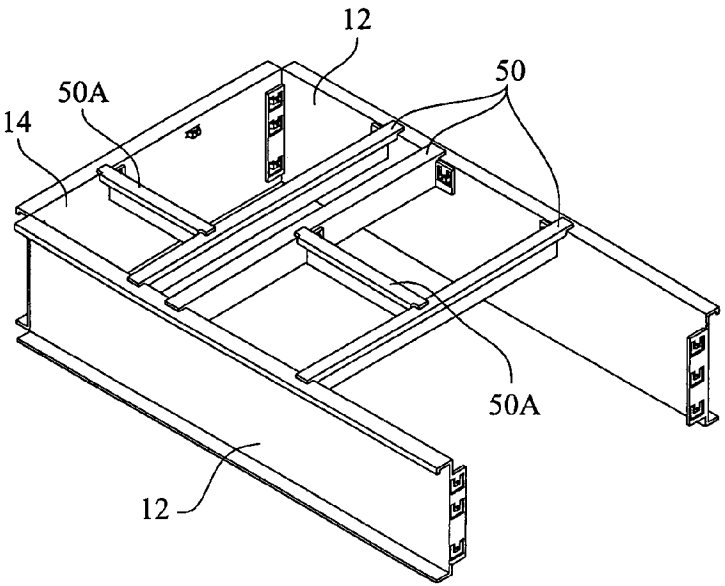
FIG. 4 is the same view as FIG. 3 but with the assembly further assembled.
Figure 5:
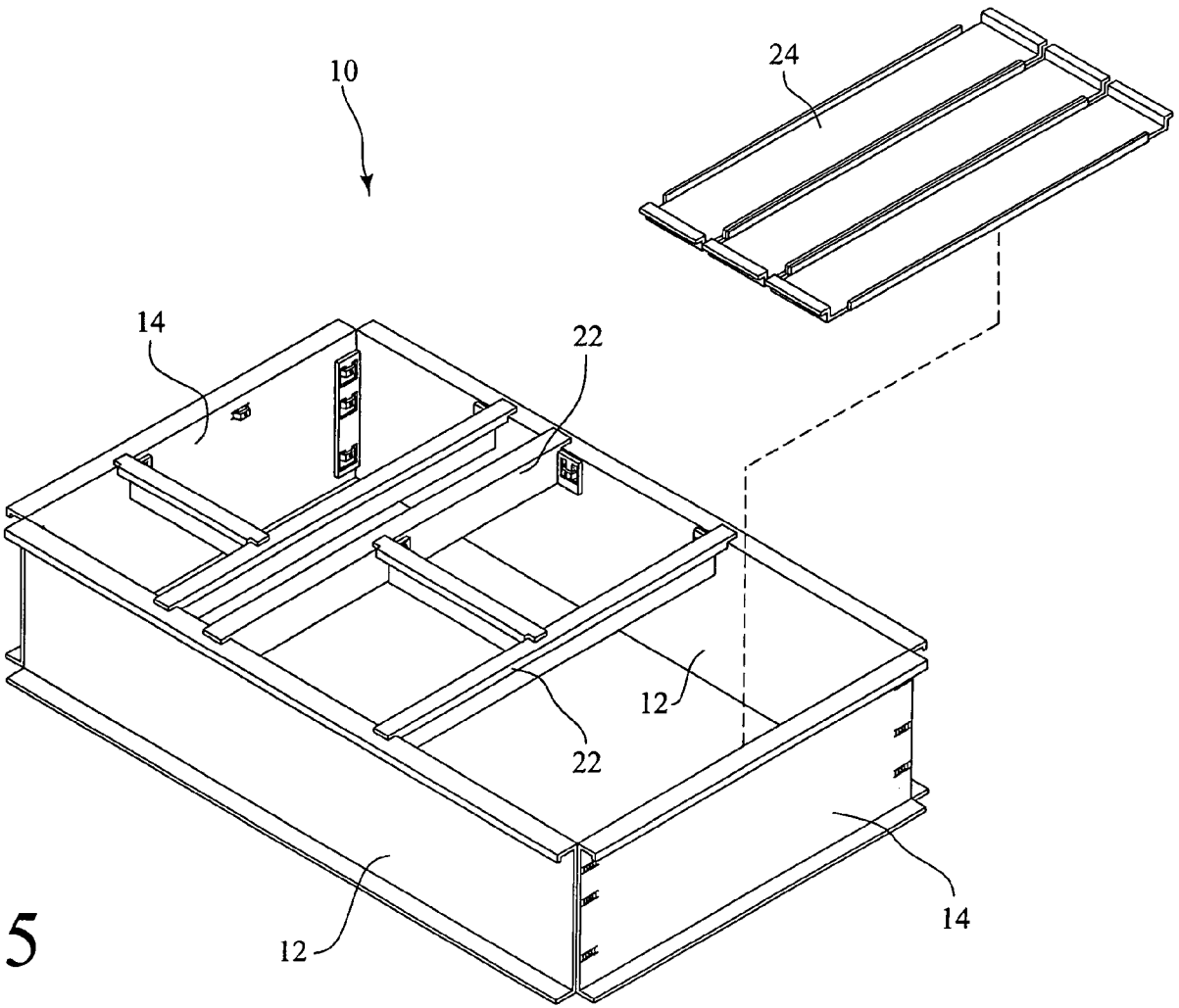
FIG. 5 is the same view as FIG. 4 but with the assembly further assembled.

FIGS. 1–11 show a first embodiment of a roof curb 10 made in accordance with the present invention. As shown in FIG. 5, the roof curb 10 is made up of a plurality of exterior planar panels 12, 14 connected together to form a rectangular box. As shown in FIG. 1, the curb 10 rests on top of a roof 16, surrounding an opening 18 in the roof 16, and an air conditioner unit 20 or other utility rests on top of the curb 10, thereby providing access from the air conditioner unit 10 through the curb 10 and through the roof 16.

The air conditioning unit 20 may have various ducts (not shown) which are to communicate through the curb 10, and, as shown in FIG. 5, the curb 10 may be designed with various-sized openings 22 to receive those ducts. In addition, portions of the curb 10 may be blocked off with plates 24, which rest on top of the curb 10.

Referring to FIGS. 2–5, this particular curb 10 is made up of two long exterior planar panels 12 of equal length and two short exterior planar panels 14 of equal length, which, when connected together with adjacent panels at right angles, forms a rectangular box. Each of the panels 12, 14 has a top edge 30, a bottom edge 32, an interior surface 34, and exterior surface 36, and first and second ends 38, 40. The panels 12, 14 are made from a flat sheet of metal that has been stamped. The top and bottom edges 30, 32 are curved outwardly. The ends 38, 40 of the long panels 12 include bent portions 42 that have been bent inwardly at a right angle to the main portion of the panel 12. Near the ends of the shorter panels 14 are formed straps 44. These bent portions 42 secure the side panels 12 to the end panels 14 through the straps, as will be described in more detail later. Also, intermediate panels 50, 50A are secured to the exterior panels 12 or 14 or to each other by means of similar bent portions and straps.

Figure 7:
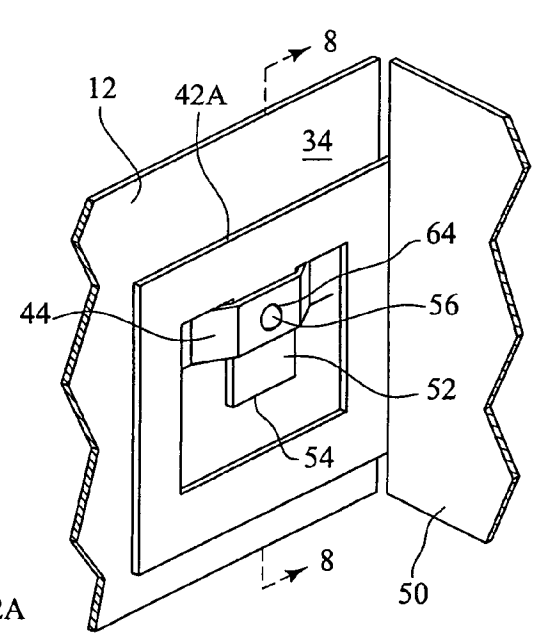
FIG. 7 is the same view as FIG. 6 but with the parts assembled.
Figure 8:
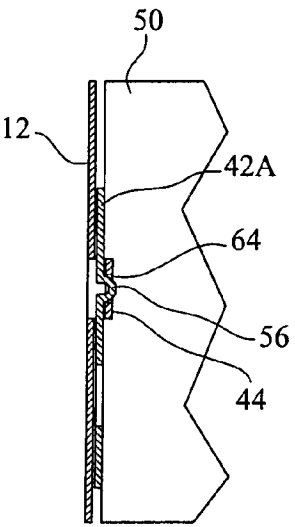
FIG. 8 is a view taken along the section 8—8 of FIG. 7.
Figure 6:
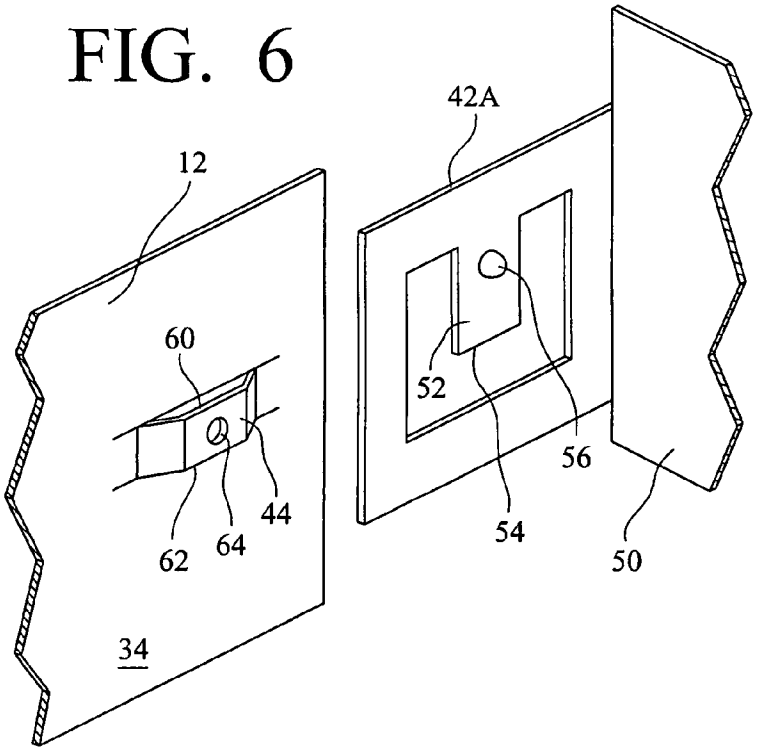
FIG. 6 is a broken-away exploded perspective view showing a connector portion of the assembly of FIG. 2.

FIGS. 6–8 show one of the intermediate panels 50 connected to one of the exterior panels 12. The intermediate panel 50 has a right angle bend 42A at one end. This right angle bend 42A has been stamped to form a downwardly-extending tab 52, which is secured to the right angle bend 42A at one end and is free at the other end 54. The tab 52 has a stamped projection 56 having a generally circular cross-section and projecting parallel to the end-to-end elongated direction of the panel 50. The exterior panel 12 has a strap 44, which has been stamped from the flat metal piece. The strap 44 extends in the lengthwise direction of the panel 12 and is connected to the exterior panel 12 at both ends. It defines a top edge 60 and a bottom edge 62 and a circular opening 64, which is sized to receive the projection 56.

In order to assemble the interior panel 50 to the exterior panel 12, the bent portion 42A is brought into alignment with the interior surface 34 of the exterior panel 12, and the free end 54 of the tab 52 is inserted between the top edge 60 of the strap 44 and the inner surface 34 of the panel 12 and is moved downwardly until the projection 56 pops through the opening 64 in the strap 44. At this point, the interior panel 50 and the exterior panel 12 are secured together, with the bent portion 42A pressing against the interior surface 34 of the panel 12 and the tab 52 pressing against the exterior surface of the strap 44, and the projection 56 and opening 64 preventing relative movement between the tab 52 and the strap 44. Thus, simply by cutting and bending the flat sheet material, the panels have been formed so that they can be assembled and secured together without the need for additional fasteners or tools. This makes assembly very simple and avoids the problem of losing small parts such as fasteners.

Figure 11:
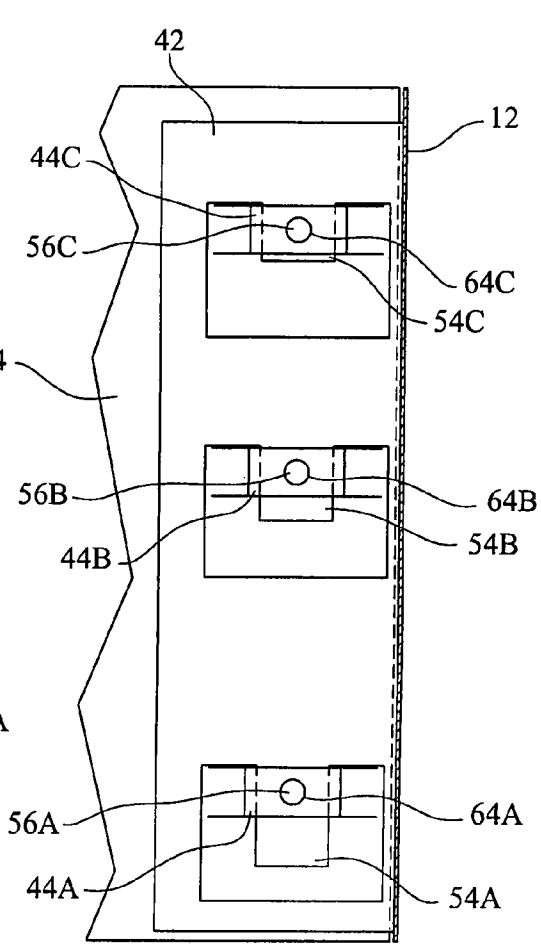
FIG. 11 is the same view as FIG. 10, but with the assembly further assembled.
Figure 10:
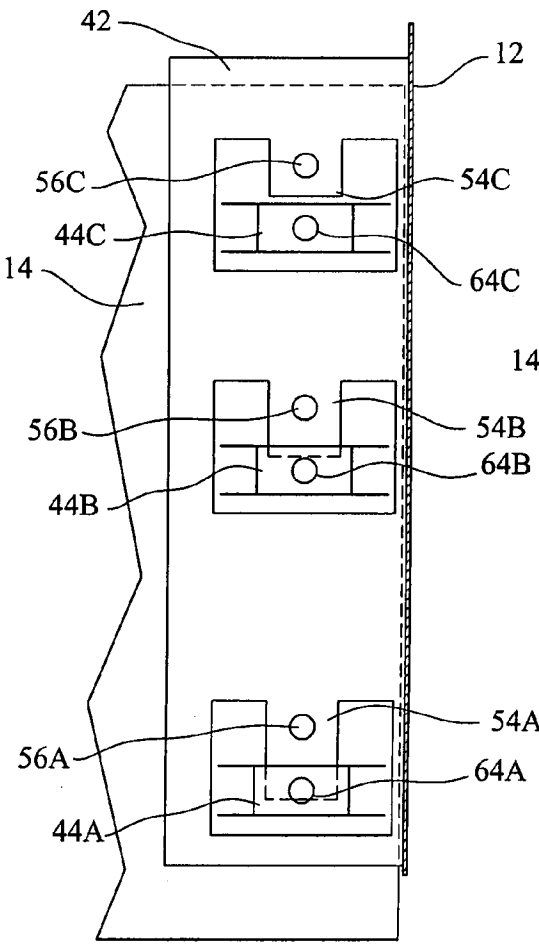
FIG. 10 is the same view as FIG. 9, but with the assembly further assembled.
Figure 9:
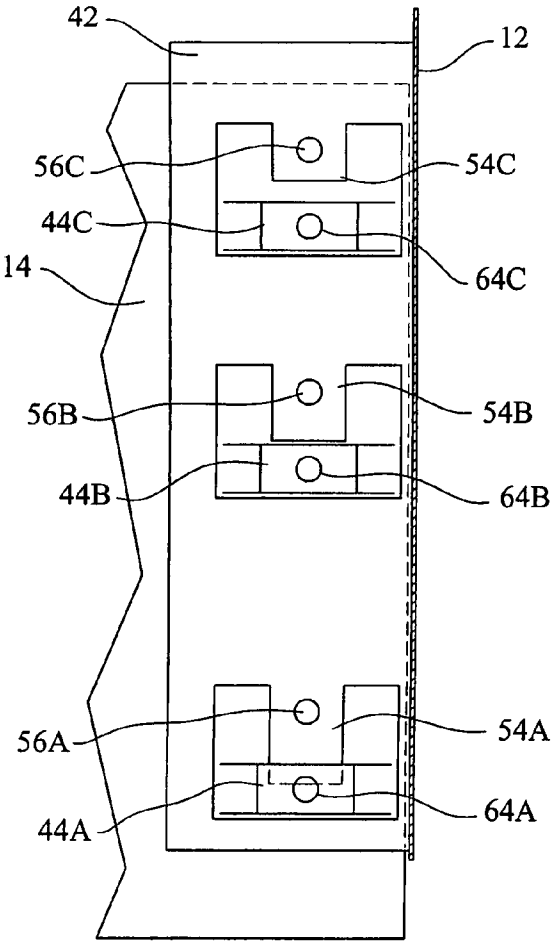
FIG. 9 is a broken-away view of one of the corners of the curb of FIG. 2 as it is being assembled.

The corners of the box are formed in a similar manner, except, in this embodiment, there are three tabs 52 and three straps 44 at each corner joint. FIGS. 9–11 show schematically how the corners are assembled. The three horizontal straps 44A–C are not evenly spaced. Instead, the bottom strap 44A is spaced a larger distance away from the center strap 44B than is the upper strap 44C. The tabs 54A–C are also similarly spaced apart from each other, ensuring that the panels 12, 14 can only be assembled in the correct orientation. Also, the distance from the bottom edge of each tab 54A–C to its respective projection 56A–C differs from one tab to the next, with the distance being greatest in the bottom tab 54A, less in the center tab 54B, and still less in the upper tab 54C. This difference in distance permits the tabs to be inserted into their respective straps one at a time, helping facilitate assembly, so that only the lowest tab 54A has to be aligned with its respective strap 44A at first, and, once that lowest tab 54A is started into its respective strap 44A, it helps align the second tab 54B with its strap 44B, and so forth.

Figure 3:
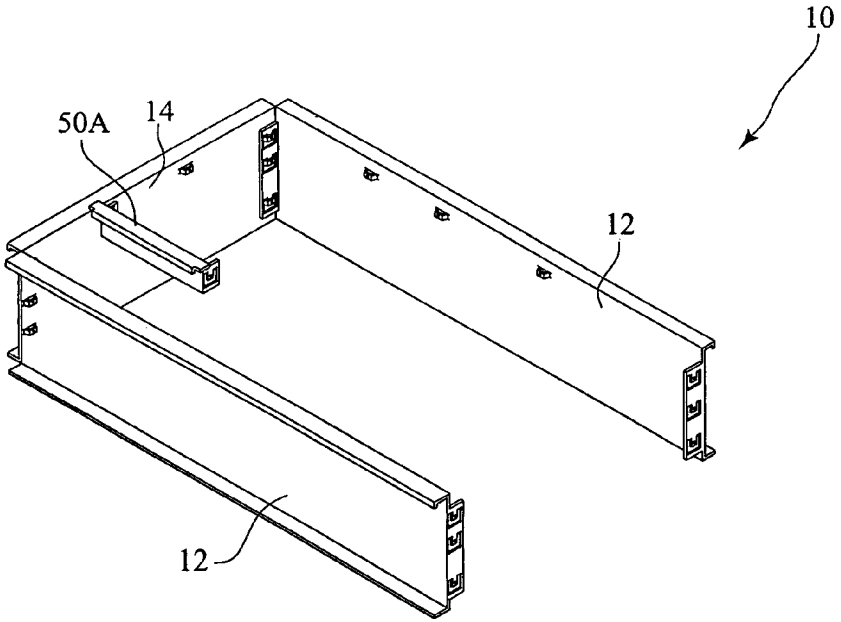
FIG. 3 is a perspective of the assembly of FIG. 2 partially assembled.

FIG. 9 shows the starting position, with the bottom tab 54A just starting into its strap 44A. This helps align the bottom edge of the middle tab 54B with its respective strap 44B. Next, FIG. 10 shows the bottom tab 54A progressing further downwardly, as the second tab 54B begins entering into the slot formed by its strap 44B. This helps align the top tab 54C with its respective strap 44C. FIG. 11 shows the panel 12 having slid down into proper alignment with the panel 14, with all three tabs 54A–C extending through their respective straps 44A–C, and all three projections 56A–C popping through their respective openings 64A–C at the same time, once the panels have reached their final positions. It will be noted in FIG. 2 that an intermediate panel 50 has an intermediate strap 44, which receives the tab from the bent end of another intermediate panel 50A, and so forth, so that the entire curb 10 is assembled using these tabs and straps, simply aligning the appropriate panels and snapping them into position, without requiring additional connectors or tools. The projections 56 and openings 64 provide positive engagement between the assembled members, so they do not come apart accidentally. FIGS. 3–5 show various portions assembled together in various stages of assembly. However, they do not show the order of assembly that is normally used. Typically, the rectangular box will be formed first from the two pairs of exterior planar panels 12, 14, and then the intermediate panels 50 will be inserted, followed by the other intermediate panels 50A. Finally, the plates 24 will be placed on top, extending from one side panel 12 to the other, with their end lips hooked over the top edges 30 of the panels 12.

It will be obvious to those skilled in the art that various modifications may be made to the embodiment described above without departing from the scope of the present invention. For example, while the straps 44 are all oriented in the horizontal direction, and this is preferred, they may be oriented in another direction, such as vertical. While the tabs are shown on the bent ends, the straps could be on the bent ends, and the tabs could be on the flat panels. While the panels are referred to as planar, they may include reinforcing ribs or other non-planar features, while still having a generally planar shape. Various other changes may also be made while still permitting assembly and positive engagement of the parts without requiring connectors or tools.

What is claimed is:

1. A roof curb, comprising:

a plurality of exterior planar panels connected together to form a rectangular box, each of said panels having a top edge, a bottom edge, an interior surface, an exterior surface, and first and second ends, and defining an elongated direction extending from said first end to said second end;

said plurality of exterior planar panels including first and second adjacent exterior planar panels;

said first adjacent exterior panel having a bent portion at its first end at right angles to its elongated direction;

one of said bent portion and said second panel defining a tab having a first end secured to its respective panel and a second end that is free, said tab also including a projection extending parallel to the elongated direction of said first adjacent exterior planar panel;

the other of said bent portion and said second adjacent exterior planar panel defining a strap having first and second ends secured to the respective panel and an intermediate portion offset from its respective panel, said intermediate portion defining first and second edges and an opening sized to receive the projection of said tab;

wherein said first and second adjacent exterior planar panels are assembled together by aligning the tab with the strap and sliding the free end of the tab into the offset intermediate portion of said strap until the projection from said tab is received in the opening in said strap, wherein the receipt of said projection in the opening of said strap limits the movement of said projection relative to said strap upwardly, downwardly, and in the longitudinal direction, thereby locking together said first and second adjacent exterior planar panels and forming a corner of said rectangular box.

2. A roof curb as recited in claim 1, wherein said first panel has a plurality of said tabs oriented in the same direction, and said other adjacent exterior planar panel has a corresponding plurality of said straps, and wherein said corresponding tabs are received in their corresponding straps, with the projections from said tabs received in the corresponding openings in said corresponding straps, securing said first and second adjacent exterior planar panels together.

3. A roof curb, comprising:

a plurality of exterior planar panels connected together to form a rectangular box, each of said panels having a top edge, a bottom edge, an interior surface, an exterior surface, and first and second ends, and defining an elongated direction extending from said first end to said second end;

said plurality of exterior planar panels including first and second adjacent exterior planar panels;

said first adjacent exterior panel having a bent portion at its first end at right angles to its elongated direction;

one of said bent portion and said second panel defining a plurality of tabs, each having a first end secured to its respective panel and a second end that is free, at least one of said tabs also including a projection extending parallel to the elongated direction of said first adjacent exterior planar panel;

the other of said bent portion and said second adjacent exterior planar panel defining a plurality of straps having first and second ends secured to the respective panel and an intermediate portion offset from its respective panel, each of said intermediate portions defining first and second edges, and at least one of said intermediate portions defining an opening sized to receive the projection of said at least one tab;

wherein said first and second adjacent exterior planar panels are assembled together by aligning the tabs with the respective straps and sliding the free ends of the tabs into the offset intermediate portions of said straps until the projection from said one tab is received in the opening in said one intermediate portion, thereby locking together said first and second adjacent exterior planar panels and forming a corner of said rectangular box; and wherein said tabs and straps are arranged with an irregular spacing so the first and second exterior planar panels can only be connected together with the panels in the correct orientation relative to each other.

4. A roof curb, comprising:

a plurality of exterior planar panels connected together to form a rectangular box, each of said panels having a top edge, a bottom edge, an interior surface, an exterior surface, and first and second ends, and defining an elongated direction extending from said first end to said second end;

said plurality of exterior planar panels including first and second adjacent exterior planar panels;

said first adjacent exterior panel having a bent portion at its first end at right angles to its elongated direction;

one of said bent portion and said second panel defining a plurality of tabs, each having a first end secured to its respective panel, a second end that is free, and a projection extending parallel to the elongated direction of said first adjacent exterior planar panel;

the other of said bent portion and said second adjacent exterior planar panel defining a plurality of straps having first and second ends secured to the respective panel and an intermediate portion offset from its respective panel, each of said intermediate portions defining first and second edges and an opening sized to receive the projection of its respective tab;

wherein said first and second adjacent exterior planar panels are assembled together by aligning the tabs with the respective straps and sliding the free ends of the tabs into the offset intermediate portions of said straps until the projections from said tabs are received in the openings in said respective intermediate portions, thereby locking together said first and second adjacent exterior planar panels and forming a corner of said rectangular box; and wherein said plurality of tabs is located on said bent end portion and have different distances between the end of the tab and its respective projection, so that a first of said tabs begins entering its respective strap before a second of said tabs enters its respective strap, and so that the projections from both said first and second tabs align with their respective openings at the same time.

5. A roof curb, comprising:

a plurality of exterior planar panels connected together to form a rectangular box, each of said panels having a top edge, a bottom edge, an interior surface, an exterior surface, and first and second ends, and defining an elongated direction extending from said first end to said second end;

said plurality of exterior planar panels including first and second adjacent exterior planar panels;

said first adjacent exterior panel having a bent portion at its first end at right angles to its elongated direction;

one of said bent portion and said second panel defining a tab having a first end secured to its respective panel and a second end that is free, said tab also including a projection extending parallel to the elongated direction of said first adjacent exterior planar panel;

the other of said bent portion and said second adjacent exterior planar panel defining a strap having first and second ends secured to the respective panel and an intermediate portion offset from its respective panel, said intermediate portion defining first and second edges and an opening sized to receive the projection of said tab;

wherein said first and second adjacent exterior planar panels are assembled together by aligning the tab with the strap and sliding the free end of the tab into the offset intermediate portion of said strap until the projection from said tab is received in the opening in said strap, thereby locking together said first and second adjacent exterior planar panels and forming a corner of said rectangular box;

and further comprising at least one interior panel, said interior panel having at least one right angle bent end abutting the interior surface of one of said exterior planar panels, one of said interior surface and said right angle bent end comprising a tab having a free end and a projection, and the other of said interior surface and said right angle bent end having a strap defining an opening, said strap receiving said tab with said projection fitting into said opening.

6. A roof curb as recited in claim 5, wherein there is a plurality of said interior panels.

7. A roof curb, comprising:

four exterior panels connected together to form a rectangular box, including two side panels and two end panels, with adjacent panels connected to each other to form the corners of the box;

each of said panels having a top edge, a bottom edge, an interior surface, an exterior surface, and first and second ends, and defining an elongated direction extending from the first end to the second end;

each of said side panels having bent portions at its first and second ends at right angles to its elongated direction; wherein one of said respective bent portion and its respective adjacent end panel defines a tab having a first end secured to its respective panel and a second end that is free, said tab also including a projection extending parallel to the elongated direction of said side panels; and wherein the other of said bent portion and said end panel defines a strap having first and second ends secured to its respective panel and an intermediate portion offset from its respective panel, said intermediate portion defining first and second edges and an opening sized to receive the projection of said tab;

wherein said side panels and end panels are assembled together by aligning the respective tabs with the respective straps and sliding the free ends of the tabs into the offset intermediate portions of the straps until the projections from the tabs are received in the openings in the respective straps, wherein the receipt of said projections in the openings of said respective straps limits the movement of the projections relative to the straps upwardly, downwardly, and in the longitudinal direction, thereby locking together the side panels and end panels and forming the corners of said rectangular box.

8. A roof curb as recited in claim 7, wherein the tabs are on the bent portions of the side panels and the straps are on the end panels.

9. A roof curb as recited in claim 8, wherein at least some of said panels define intermediate straps, and further comprising intermediate panels having bent ends defining tabs, which are received in their respective intermediate straps.

10. A roof curb, comprising:

four exterior panels connected together to form a rectangular box, including two side panels and two end panels, with adjacent panels connected to each other to form the corners of the box;

each of said panels having a top edge, a bottom edge, an interior surface, an exterior surface, and first and second ends, and defining an elongated direction extending from the first end to the second end;

each of said side panels having bent portions at its first and second ends at right angles to its elongated direction; wherein one of said respective bent portion and its respective adjacent end panel defines a tab having a first end secured to its respective panel and a second end that is free, said tab also including a projection extending parallel to the elongated direction of said side panels; and wherein the other of said bent portion and said end panel defines a strap having first and second ends secured to its respective panel and an intermediate portion offset from its respective panel, said intermediate portion defining first and second edges and an opening sized to receive the projection of said tab;

wherein said side panels and end panels are assembled together by aligning the respective tabs with the respective straps and sliding the free ends of the tabs into the offset intermediate portions of the straps until the projections from the tabs are received in the openings in the respective straps, thereby locking together the side panels and end panels and forming the corners of said rectangular box; and wherein each of the corners of said box is secured by at least three pairs of straps and tabs, which are spaced apart at an irregular spacing so that the side panels and end panels can only be assembled in one orientation relative to each other.

11. A roof curb as recited in claim 10, wherein there is a different distance between the end and the projection on each of the three tabs at each corner, so that each of the three tabs can be inserted into its respective strap at a different time during the progression of the corner assembly, and so that all three of the projections reach their respective holes at the same time.

* * * * *